US006960844B1

(12) United States Patent
Al-Hosini et al.

(10) Patent No.: US 6,960,844 B1
(45) Date of Patent: Nov. 1, 2005

(54) ELECTRIC SWITCHING DEVICE

(75) Inventors: Falah Al-Hosini, Västerås (SE); Jan Smede, Västerås (SE); Jan-Anders Nygren Nolemo, Västerås (SE); Magnus Backman, Västerås (SE); Philip Kjaer, Västerås (SE); Lennart Balgård, Arboga (SE); Per Larsson, Västerås (SE); Ove Albertsson, Västerås (SE); Lars Jonsson, Västerås (SE); Jan Johansson, Arboga (SE)

(73) Assignee: ABB Technology AG, Zurich (CH)

( * ) Notice: Subject to any disclaimer, the term of this patent is extended or adjusted under 35 U.S.C. 154(b) by 405 days.

(21) Appl. No.: 10/130,351

(22) PCT Filed: Nov. 20, 2000

(86) PCT No.: PCT/SE00/02273

§ 371 (c)(1),
(2), (4) Date: Aug. 28, 2002

(87) PCT Pub. No.: WO01/37298

PCT Pub. Date: May 25, 2001

(30) Foreign Application Priority Data

Nov. 18, 1999 (SE) ..... 9904166

(51) Int. Cl.[7] ..... H01H 83/00
(52) U.S. Cl. ..... 307/131; 307/141.8; 361/3
(58) Field of Search ..... 307/130, 131, 307/138, 141.8, 126; 361/3, 8

(56) References Cited

U.S. PATENT DOCUMENTS

| | | | | |
|---|---|---|---|---|
| 3,864,604 A | | 2/1975 | Pfanzelt | 317/11 A |
| 4,203,040 A | * | 5/1980 | Abbondanti et al. | 307/65 |
| 4,754,360 A | | 6/1988 | Nakada | 361/8 |
| 5,040,417 A | * | 8/1991 | Rowlette | 73/335.05 |
| 5,566,041 A | | 10/1996 | Rumfeldt | 361/115 |

FOREIGN PATENT DOCUMENTS

| | | |
|---|---|---|
| DE | 2209500 | 6/1973 |

* cited by examiner

*Primary Examiner*—Brian Sircus
*Assistant Examiner*—Brett Squires
(74) *Attorney, Agent, or Firm*—Dykema Gossett PLLC

(57) ABSTRACT

An electric switching device for alternating current comprises two branches (2, 3) connected in parallel in a current path and having each at least two contact members (4–7) connected in series. A semiconductor device (8) is adapted to interconnect the midpoints between the two contact members of each branch. When opening the current path a first contact member (5) of one, first branch located before said midpoint as seen in the current direction existing is controlled to open and a second contact member (6) of the second branch located after the midpoint as seen in the current direction is controlled to open for transferring the current to a temporary current path through the semiconductor device. The current path through the switching device is then broken when the semiconductor device is in a blocking state by opening a contact member (4, 7) of the switching device arranged in the temporary current path.

44 Claims, 7 Drawing Sheets

ELECTRIC SWITCHING DEVICE

FIELD OF THE INVENTION AND PRIOR ART

The present invention relates to an electric switching device for alternating current comprising at least two contact members arranged in a current path through the switching device and a semiconductor device able to block current therethrough in at least a first blocking direction and a unit adapted to control opening of a current path through the switching device by controlling a first of the contact members to open for transferring the current through the switching device to the semiconductor device when this is in or going into the conducting state and then the second contact member to open when the semiconductor device is in a state of blocking current therethrough for breaking the current through the switching device.

Such electric switching devices are usually called hybrid breakers, and it is characterizing for them that they are able to achieve an arc-free breaking of the current path through the switching device, since this takes place when the semiconductor device is in blocking state and no current flows through the switching device. In switching devices having contact members breaking the current therethrough, and in which accordingly an arc is generated, the gas pressure inside the breaker used has to be high for achieving a sufficient insulation and breaking performance or vacuum has to be provided inside the breaker for the same reason. Quite an amount of energy is needed in the first case for blowing out the arc, while in the second case a comparatively high contact pressure for a good contact is needed, which consumes a not negligible amount of energy. The corresponding amount of energy may in a switching device according to the introduction having an arc-free breaking in the way mentioned instead be used for making the breaking more rapid so as to better protect different types of electrical equipment connected to said current path upon occurrence of faults and reduce the material wear of contacts included in the second contact member.

The invention is of course not restricted to any particular range of operation current through such an electric switching device in the closed state, and neither to any particular voltage levels existing in said current path, but it may nevertheless be mentioned that it is particularly useful for intermediate voltage, i.e. corresponding to 1–52 kV system voltage, in which the operation current in question typically may be 1 kA, but both lower and higher voltages and currents than these are conceivable.

Such and electric switching device is generally used for obtaining breaking of a current path upon occurrence of any fault, such as a short-circuit, along the current path. The fault may for example be caused by cutting off a cable of an alternating voltage distribution network by a digging machine. It is then important to break the current rapidly for minimizing damage on persons and material. It is not necessary, but well possible that the second contact member of such a switching device accomplishes a breaking visible to the eye, i.e. functions as a disconnector, which is necessary when the breaking of the current is made for carrying out any type of maintenance work along the current path, for example after a tree has fallen down onto a transmission line.

A switching device of this type is particularly well suited to be arranged within a switch gear for supply of electricity within industries or in distribution or transmission networks. It may also be mentioned that it may advantageously be used for being able to rapidly disconnect a generator and other apparatuses from an alternating voltage network for protecting them against different types of disturbances or faults on the alternating voltage network.

It is pointed out that "conducting state" above is to be given a broad sense, and it is not necessary that a component going into or being in the conducting state really conducts, but this is also intended to cover that it may be brought to conduct in that moment should that be desired, which could be the case for a semiconductor device of turn-on type, such as a thyristor, while a passive semiconductor device in the form of a diode instead always will conduct in the conducting state as defined here.

Furthermore, it is pointed out that "contact member" comprises all types of members for opening and closing an electric circuit, in which for example although not necessarily, physical separation of two parts while forming a gap therebetween may take place when opening the contact member, and this may for example take place by moving a movable contact interconnecting two contacts mutually spaced so that these are no longer in connection with each other or by the fact that a movable contact bears against a fixed contact and is moved away therefrom. Contact members without physical separation of contacts when opening are also conceivable.

Electric switching devices of the type mentioned in the introduction already known, such as for example the one known through U.S. Pat. No. 4,459,629, have a comparatively costly control electronic so as to accomplish opening of the two contact members when there is a desire to break said current path or closing the contact members when re-establishing the current path in a well defined way through an exact co-ordination required of the control of the two contact members.

Another disadvantage of so-called hybrid breakers already known is that they leave something to be desired with respect to the rapidity by which the breaking may take place, since a certain position of the alternating voltage for said current path has to be waited for before the breaking procedure may be started. It has been tried to solve this problem by arranging semiconductor devices in different switching circuits of such an electric switching device for using separate semiconductor devices in different positions of the instantaneous alternating current in said current path so as to shorten the time between discovery of a need of breaking and a completed opening of the current path through the switching device. However, the semiconductor devices stand for a considerable part of the total cost for such a switching device, which means that such a solution gets costly.

SUMMARY OF THE INVENTION

The object of the present invention is to provide an electric switching device of the type defined in the introduction, which shows a possibility to a rapid opening of said current path when a need thereof arises independently of the instantaneous position of the alternating current without making the switching device exaggeratedly costly and at the same time requires only low control energy.

This object is according to the invention obtained by the fact that the total number of contact members of the switching device is at least four with two connected in series in each of two branches connected in parallel in said current path, that the semiconductor device is arranged to connect the midpoints between the two contact members of each branch to each other, that the switching device comprises at least a member adapted to detect the direction of the current through the switching device, that the control unit is adapted to control opening of the current path by controlling the first contact member located before said midpoint with respect to the current direction prevailing of one first branch to open and a second contact member of the second branch located after the midpoint with respect to the current direction to open for transferring the current to a temporary current path through the semiconductor device when this is in or going into the conducting state and then break the current path through the switching device when the semiconductor device is in a state of blocking current therethrough by opening at least one contact member of the switching device arranged in the temporary current path through the semiconductor device, and that the control unit is adapted to chose which branch shall be the first one on the basis of information from the detecting member.

By this design of the switching device a predetermined breaking sequence may be started as soon as a need thereof is detected, although the switching device may have one single said semiconductor device, since said contact members may always be controlled so that a temporary current path in one and the same direction through the semiconductor device may be accomplished independently of the direction of the alternating current through the switching device. The cost for semiconductor devices may in this way be at least half as high with respect to other known hybrid breakers with a similar rapidity, which have two semiconductor devices directed in opposite directions instead of one.

According to a preferred embodiment of the invention the control unit is adapted to open at least one of a) the second contact member of the first branch and b) the first contact member of the second branch after the transfer to the temporary current path for breaking the current path through the switching device. By utilizing one of these contact members for breaking the temporary current path it is possible to keep the number of contacts of the switching device and by that the cost therefor down.

According to another preferred embodiment of the invention the switching device comprises at least one movable contact part arranged to establish a galvanic connection between two fixed contacts of the respective contact member and break this connection for closing and opening, respectively, the contact member. This constitutes a simple and reliable way to operate the contact members.

According to a particularly preferred further development of the embodiment of the invention last mentioned the switching device has one single said movable part for all contact members arranged along one and the same of said branches connected in parallel, the movable part is adapted to close all the contact members of the branch in question in the closed state of the switching device, and the unit is adapted to control this movable part to carry out one single mechanical movement for opening or closing the contact members of the respective branch. This results in the possibility to a very simple control of the separate contact members, so that no complicated control electronic is required for this. It is then particularly advantageous if the two movable parts are interconnected for opening and closing, respectively, the current path through the switching device through one single mechanical movement of a unit in which the two movable parts are included. The opening and the closing of the current path through the switching device may by this take place while perfectly synchronizing the opening and the closing, respectively, of the different contact members by very simple means. Another advantage is that one single driving arrangement may be used for achieving all openings by driving said unit and by that both movable parts to carry out one movement. It is here pointed out that the two movable parts could be interconnected in such a way that they in the practice are constituted by one and the same part, but it is then necessary that the portions of this part forming one of said movable part each are electrically insulated with respect to each other. By the fact that the opening or closing of the electric switching device takes place by one single mechanical movement improved possibilities to make the operation faster are obtained, since only one acceleration of one movable part is necessary.

According to a very preferred embodiment of the invention the switching device comprises a driving member being electrically controlled and adapted to carry out movement of the movable part of the switching device for opening or closing contact members included therein, and it is particularly advantageous if this driving member is an electromagnetic machine in the form of an electric motor. By using such a driving member it gets possible to control the movement of the movable part for breaking and closing very accurately and for example ensure that a separation of two contacts takes place at a particular phase position of the alternating current. By arranging a control unit in the form of an electronic unit adapted to control the driving member it is then also possible to influence the movement of the movable part also when this has already been started so as to make adaptations to newly measured values of parameters, such as current or voltage, and possibly interrupt the entire procedure, if it is discovered that there is no longer any need thereof or that the movement should for example rather take place in the opposite direction. Furthermore, this embodiment is suited for co-ordination with a prediction of the future development of the current through the switching device, such as a future zero-crossing of the current so as to co-ordinate a breaking of the current through the switching device with such a prediction, for example for ensuring that said component with ability to block current will only conduct current during a so-called short half wave. By the possibility to in this way ensure that the semiconductor device, such as a diode, only has to conduct current during a very short time, in the order of half a current period, this component has not to be dimensioned for being able to withstand operation currents during a long time, but it may instead be allowed to be substantially overloaded once it has to conduct, since this only takes place during a very short time. This means that fewer such semiconductor devices may be used than otherwise would be the case if they had to withstand the currents in question over a long time.

According to another preferred embodiment of the invention the contact members belonging to one and the same of said two branches are arranged along an arc. This enables a closing or opening of the current path through the switching device by a rotation of the movable part, which improves both the flexibility and the possibility to rapidly move the movable part to another position than it had before, after a certain movement thereof. After opening said current path through rotating said movable part in one direction if would for example be possible to close the current path again either by rotating the movable part back to the closed position in the opposite rotation direction or continue the rotation of the movable until the closed position is obtained. It also gets simpler to operate the switching device by for example one electric motor.

According to another preferred embodiment of the invention the contact members belonging to one and the same of said two branches are arranged along a straight line, and the contact members are adapted to be closed by said movable part by a relative movement of a male and a female means for engagement with each other. This makes it possible to let the contacts of such a contact member in the closed position obtain a continuously surrounding electric contact to each other without any interruption, so that problems due to asymmetric contact and current forces are avoided. It has then turned out to be advantageous to design the movable part as the male means and make arrangements so that a female contact means is adapted to come to bear around the movable part at a movement thereof into the female means.

According to another preferred embodiment of the invention the switching device comprises members adapted to substantially continuously detect the direction and the magnitude of the current through the switching device and send information thereabout to the control unit, which makes it possible for the control unit to instantaneously react upon irregularities of the current, which could motivate a breaking of the current path in question.

According to another preferred embodiment of the invention the switching device comprises a current limiting device connected in parallel with the semiconductor device, and said current limiting device is adapted to start conducting at a voltage thereacross close to the maximum voltage withstood by the semiconductor device. By the fact that in the closed and opened state of the switching device no voltage will be applied across the semiconductor device and thereby neither across the current limiting device this is possible, so that this will not be heated by any leakage currents therethrough. Through the voltage limiting device, which may be a varistor, the first voltage peak occurring across the semiconductor device through the returning voltage after opening the first contact member, may be limited, which in the case of one single semiconductor device makes it possible to dimension it for being able to hold a lower returning voltage in the blocking direction thereof and thereby be less expensive then otherwise, but particularly in the case of a plurality of semiconductor devices connected in series the number of such semiconductor devices connected in series having a determined voltage withstanding capability may be reduced through an arrangement of such a varistor in parallel with each semiconductor device. It is hereby avoided that any individual semiconductor device gets a higher voltage thereacross than it may withstand, while other semiconductor devices get a lower voltage thereacross.

According to another preferred embodiment of the invention the switching device comprises means adapted to influence the voltage to increase when separating two contacts in connection with opening of the first contact member. The voltage at the contact separation is normally in the order of 12–15 V, and it drives the transfer of the current to the semiconductor device connected in parallel therewith. The higher this voltage the quicker the current may be fed into the semiconductor device. Less material wear is obtained by the arrangement of this means and the contact position will also be more stable with respect to the insulation.

According to another preferred embodiment of the invention said means comprises a plurality of first contact members connected in series and adapted to be opened substantially simultaneously for transferring the current to the semiconductor device. The voltage for driving the conduction of the semiconductor device may be increased through such a series connection of a plurality of contact members, since this voltage will be formed by an addition of the voltages of the contact members connected in series with exactly said advantageous result as a consequence.

According to another preferred embodiment of the invention said means are formed by the fact that the contacts included in the first contact member have at least a part of ablating material adapted to be heated and evaporated to gases for gas blowing on an arc when separating the two contacts when opening the first contact member, which also causes a higher arc-voltage and a faster commutation of the current to the semiconductor device.

According to a preferred embodiment of the invention the semiconductor device is a diode, which often will be preferred, since such a solution is inexpensive with respect to other controllable semiconductor devices and also very reliable. However, it is also conceivable that the semiconductor device is controllable, such as a thyristor, and it may also be of turn-off type, such as a GTO or an IGBT, for enabling a quicker breaking process. It could also in some situations be advantageous to arrange a bi-directional semiconductor device, i.e. a semiconductor device which may block and conduct in both directions, such as a BCT (bi-directionally controlled thyristor).

If a semiconductor device of a material having a wide energy gap between the valence band and the conduction band is used, i.e. an energy gap exceeding 2.5 eV, such as SiC and diamond, comparatively high voltages may be handled by the switching device while utilizing a low number of semiconductor devices.

The invention also relates to advantageous uses of a switching device as above in accordance with the appended claims, and advantages thereof appear without any doubt from the discussion above.

The invention also relates to a switch gear for supply of electricity within industry or in distribution and transmission networks provided with an electric switching device according to the invention. The method according to the invention is also excellently suited for being carried out through a computer program provided with suitable program steps, and the invention also relates to such a program as well as a computer readable medium on which such a program is recorded.

Further advantages as well as advantageous features of the invention appear from the following description and the other dependent claims.

BRIEF DESCRIPTION OF THE DRAWINGS

With reference to the appended drawings, below follows a description of preferred embodiments of the invention cited as examples.

In the drawings.

DETAILED DESCRIPTION OF PREFERRED EMBODIMENTS OF THE INVENTION

Figure 1:
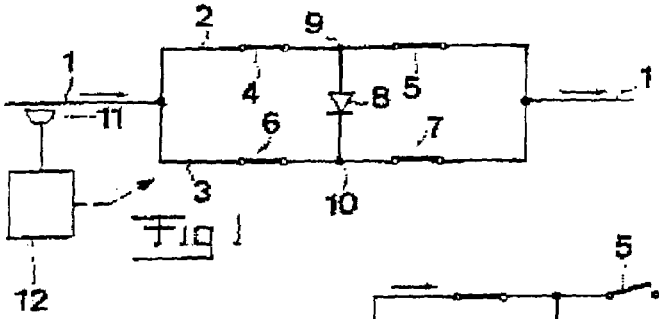
FIGS. 1–3 are simplified circuit diagrams illustrating an electric switching device according to a first preferred embodiment of the invention in a closed, temporary closed and opened position, respectively.

The general construction of an electric switching device for alternating current according to the invention is schematically illustrated in FIG. 1 and this is connected in a current path 1 for being able to rapidly open and close this path. One such switching device is arranged per phase, so that a three-phase network has three such switching devices on one and the same location. The switching device comprises two branches 2, 3 connected in parallel in said current path and each having at least two mechanical contact members 4–7 connected in series. A semiconductor device 8 in the form of a diode is adapted to connect the midpoints 9, 10 between the two contact members of each branch to each other.

The switching device comprises also a detecting member 11 schematically indicated and adapted to detect the direction and magnitude of the current in the current path and send information thereabout to a unit 12 adapted to control the contact members 4–7 in a way to be described further below. The control unit will in this way all the time know what the current instantaneously look like and be instantaneously able to control the contact members in the way desired.

The function of this electric switching device is as follows: When a desire to break the current path 1 occurs, for example by the detection of a very high current in the current path 1 by the detecting member 11, which may be caused by a shortcircuit therealong, the control unit 12 firstly decides which two contact members, here the contact members 5 and 6 (see FIG. 2), are to be opened so as to establish a temporary current path through the semiconductor device 8. Thus, this decision depends upon in which position the current in the current path is then. In the position according to FIG. 1 the entire current flows through the switching device through the two branches 2, 3 and nothing through the diode. When now the breaking is to take place the current shall as rapid as possible be transferred to flow through the diode instead. The current may be switched in to the diode from a certain direction during that part of an alternating current period that is located between the time shortly before the diode gets forward biased until the diode gets reversed biased next time. This means when a whole period is 20 ms in the practice that an opening of the contact members according to FIG. 2 may take place for example about 2 ms before zero-crossing towards the forward biased direction until the next zero-crossing. When the wrong half-period of the alternating voltage for opening the contact members 5 and 6 according to these conditions prevails, the contact members 4 and 7 may then instead be immediately opened for establishing that temporary current path instead. Accordingly, this temporary current path may be established immediately after detecting the need of opening of the switching device. By using an electrically controlled driving member, an electronic unit for the control thereof and a prediction of a future zero-crossing of the current the opening of this first contact member may be controlled to take place substantially at such a zero-crossing, which means within about 0,5 ms before and about 0,5 ms after such a zero-crossing. This means that the current to be commutated over to flow through the diode is small and the commutation may therefore take place quickly without any high demand on means for increasing the voltage across this contact member.

Figure 2:
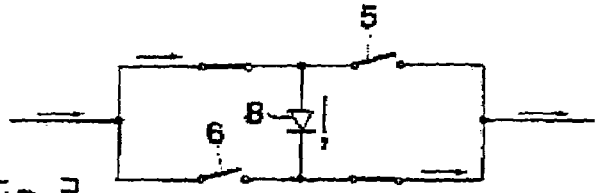

When the temporarily closed position illustrated in FIG. 2 is obtained by opening the contact members 5, 6 a small spark is created in the gap between the contacts of the respective contact member, which results in a voltage of usually 12–15 V, which will drive the transfer of the current through the diode 8. With reference to FIGS. 4–6 and FIGS. 21 and 22 possible ways to make the transfer of the current quicker will be described further below.

Figure 3:
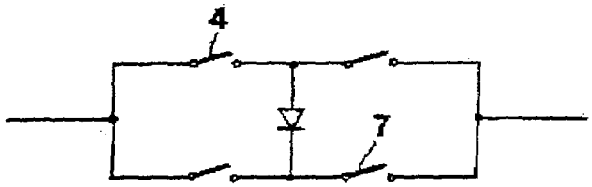

When then the voltage across the switching device changes direction no current will flow therethrough, but a voltage will be built up across the diode 8 then reverse biased and at least one of the two other contact members 4, 7 is now opened, so that the temporary current path is broken, in which this breaking may take place arc-free, since no current flows through the contact site at the time for the breaking. The completely open position according to FIG. 3 is thereby obtained. It is in this breaking important that it takes place so fast that the voltage across the diode 8 will not change direction again and this starts to conduct. By the fact that the frequency of the opening of the contact members may be controlled in dependence upon the position of the alternating current when a need of opening of the switching device occurs the switching device may be brought between the closed position and the completely open position according to FIG. 3 within a period of time being substantially shorter than a period, usually always within 15 ms for a frequency of 50 Hz of the alternating voltage.

By the fact that in the closed position of the switching device the current never flows through the diode 8 the contact members 4–7 have only to be dimensioned for the operation current, which may for example be 1000 A, while the diode is dimensioned for a possible shortcircuit current, which in such a case could be 25 kA. However, it only has to withstand that current during a very short time, and the dimensioning of the diode may be made without any considerations taken to any continuous operation current through the switching device. Furthermore, the diode has to be dimensioned for a returning voltage that during a short period of time is applied thereacross after opening the two contact members opened firstly. This may in the case of a network voltage of 12 kV for example be about 20 kV. However, the very contact members of the switching device have in the open position according to FIG. 3 to be able to withstand a considerably higher so-called impulse voltage, which in this case could be 75 kV.

The switching device may advantageously be arranged in such a way that the breaking location in the position according to FIG. 3 is visible, i.e. as disconnector, so that works may be carried out along the current path in this position. The utilization of the same semiconductor device in the temporary current path independently of in which direction this takes through the switching device makes great cost savings possible by reducing the number of semiconductor devices substantially with respect to switching devices of this type already known.

Figure 4:
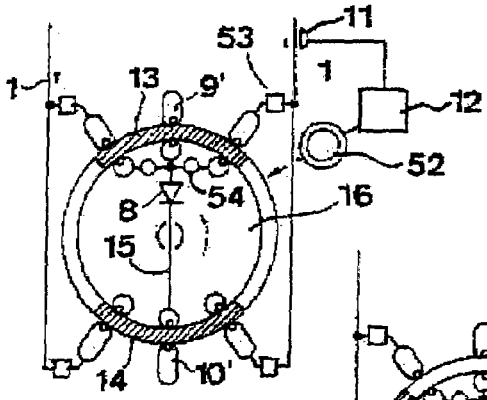
FIGS. 4–6 are simplified views illustrating an electric switching device according to a preferred embodiment of the invention in the positions according to FIGS. 1–3, FIGS. 7–9 are simplified views illustrating an electric switching device according to a second preferred embodiment of the invention in the positions according to FIGS. 1–3, FIGS. 10–12 are simplified views illustrating an electric switching device according to a third preferred embodiment of the invention in the positions according to FIGS. 1–3, FIGS. 13–15 are simplified views illustrating an electric switching device according to a fourth preferred embodiment of the invention in the positions according to FIGS. 1–3.
Figure 5:
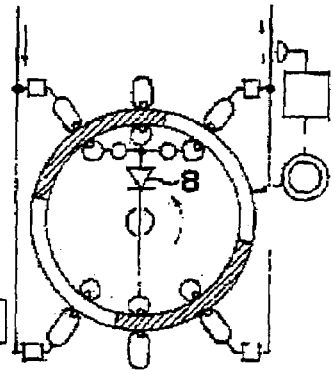
Figure 6:
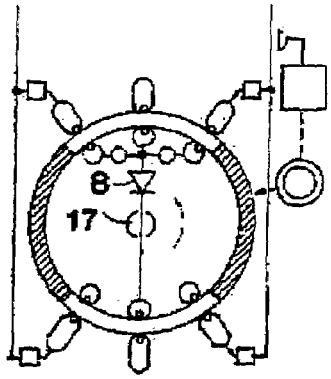

It is schematically illustrated in FIGS. 4–6 how an electric switching device for alternating current according to a first preferred embodiment of the invention and having the function illustrated in FIGS. 1–3 is constructed. This has two movable contact parts 13, 14, which are adapted to make a galvanic connection to two fixed contacts of the respective contact member for closing the contact member. The respective movable part is arranged to close all the contact members of a branch each of the branches 2, 3 in the closed state of the switching device. Two additional fixed contacts 9', 10' are here also arranged between the two contact members of the respective branch and a branch 15 between the two other branches, in which the semiconductor device is arranged, and these fixed contacts are also adapted to be galvanically connected to each other by the respective movable part 13, 14. The two movable parts 13, 14 are rigidly connected to each other by being arranged on one and the same disc 16, which is arranged to be able to rotate freely around a centre axis 17. It is apparent from the description above how the electric switching device according to FIGS. 4–6 is transferred from the closed position according to FIG. 4 to the completely open position according to FIG. 6, and it is accordingly the state of the current through the switching device prevailing at the time for detecting a need of opening that decides in which direction the movable parts 13, 14 shall rotate for the quickest possible opening of the switching device. An electrically controlled driving member 52 in the form of an electric motor is adapted to drive the movement of the movable parts 13, 14. The control unit 12 is an electronic unit, so that the movement of the movable parts 13, 14 may be controlled very accurately and be adjusted or interrupted as long as it goes on.

Two alternatives to quickly commutate the current to flow through the diode when the opening of a first contact member has taken place are also shown in FIGS. 4–6. One alternative is shown in the form of resistance increasing components 53 arranged between the connection of the respective contact to the current path 1 and the contact. This resistance increasing component is intended to be controlled by the electronic unit 12 to either have a negligible resistance in the closed state of the switching device according to FIG. 4 or get a comparatively high resistance for taking a voltage thereacross. The resistance increasing component could be a resistor having a controllable resistance, such as a powder having a very low resistance when applying an outer pressure thereonto, but which gets a high resistance when the pressure is removed, or a controllable semiconductor device, which has a low on-state voltage, but which may be brought to be turned off so as to then increase the resistance considerably therethrough.

It is here also illustrated how a voltage increasing means 54 corresponding to the resistance increasing components 53 is there, which here comprises a charge capacitor adapted to be switched in between adjacent contacts of the first contact member of the switching device when this is to be opened so as to quickly transfer the current through the diode 8. This is only shown for the contact members 4 and 5, but the corresponding arrangement is preferably also there for the contact members 6 and 7. By co-ordinating the separation of the contacts of the first contact member with the control through the control unit 12 of the resistance increasing component 53 to increase the resistance thereof or the voltage increasing means 54 to increase the voltage a voltage may very rapidly be built up across the diode 8 and the transfer of the current to flow through the diode will by that take place rapidly.

Figure 7:
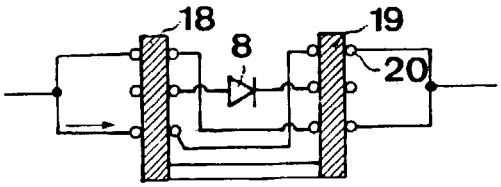
Figure 8:
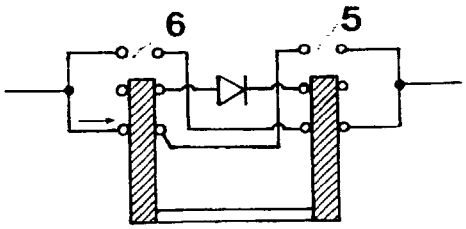
Figure 9:
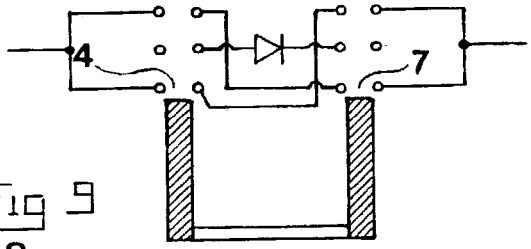

It is schematically illustrated in FIGS. 7–9 how a switching device according to a second preferred embodiment of the invention is brought between a closed position (FIG. 7), a temporarily closed position (FIG. 8) and an open position (FIG. 9). Also this switching device has two movable contact parts 18, 19, which here are of a rod-like design and adapted to function as male means adapted to be received in female means in the form of contact rings 20 for surrounding electric contact therewith. The two contact members 18 and 19 are rigidly connected to each other to one single unit, and they are adapted to be moved in parallel with each other in one and the same direction for opening or closing the switching device. The instantaneous direction of the current through the switching device decides in which direction, in FIG. 7 upwardly or downwardly, the rod-like components shall move for accomplishing an opening of the switching device starting from the position according to FIG. 7. When the current direction is the one shown in FIG. 7 a decision is taken to move the movable parts 18, 19 downwardly for establishing a temporary current path through the diode 8 as quick as possible.

Figure 10:
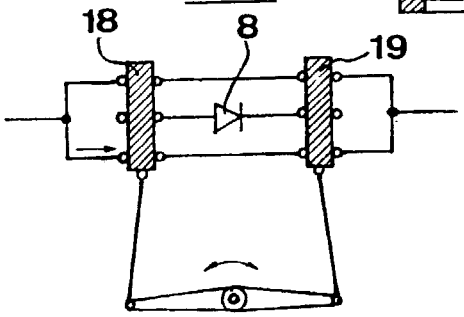
Figure 11:
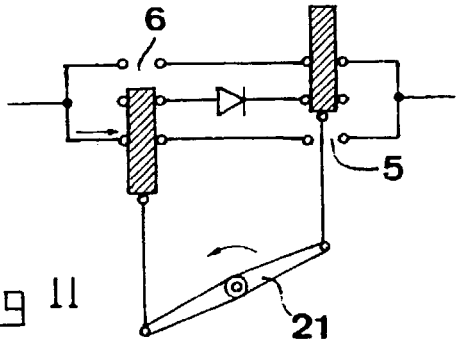
Figure 12:
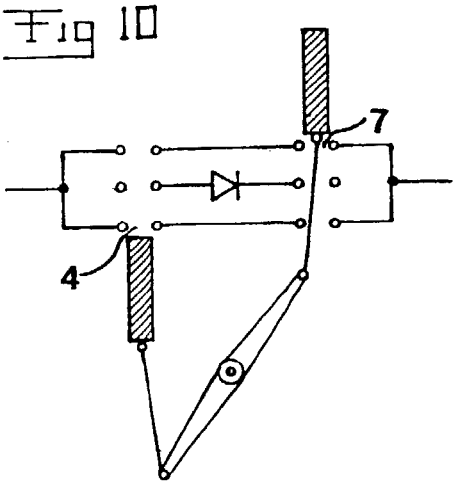

A switching device according to a further preferred embodiment of the invention is illustrated in FIGS. 10–12 and this differs from the one according to FIGS. 7–9 by the fact that the two movable parts 18, 19 are here mutually interconnected by a rocker arrangement 21 and they move substantially in parallel with each other but in opposite directions. The instantaneous position of the current through the switching device when detecting a need of an opening decides which of the two movable contact parts 18, 19 is to be moved upwardly and which is to be moved downwardly starting from the position according to FIG. 10 for establishing the temporary current path through the diode 8 as quick as possible.

Figure 13:
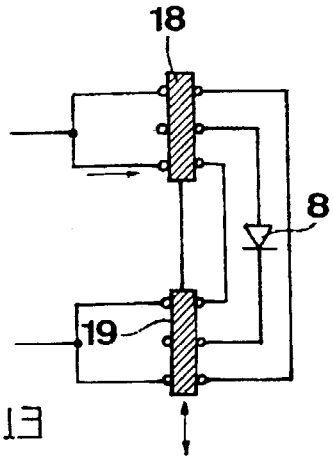
Figure 14:
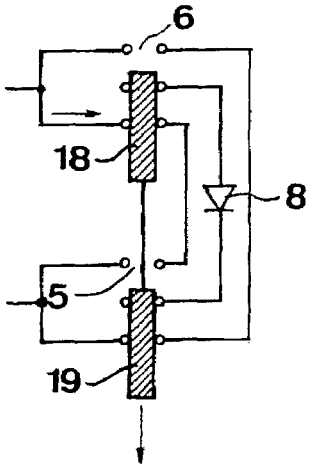
Figure 15:
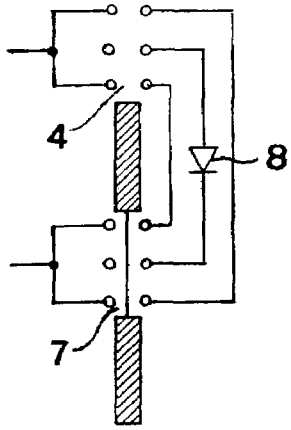

In the embodiment according to FIGS. 13–15 the two movable contact parts 18, 19 have been mechanically connected to each other for being moved together in one and the same direction along a substantially straight line. The parts are there electrically insulated with respect to each other. In which direction the movable parts shall move from the closed position according to FIG. 13 so as to obtain the temporarily closed position as quick as possible depends upon the position of the alternating current prevailing at the time for detecting the need of breaking.

Figure 16:
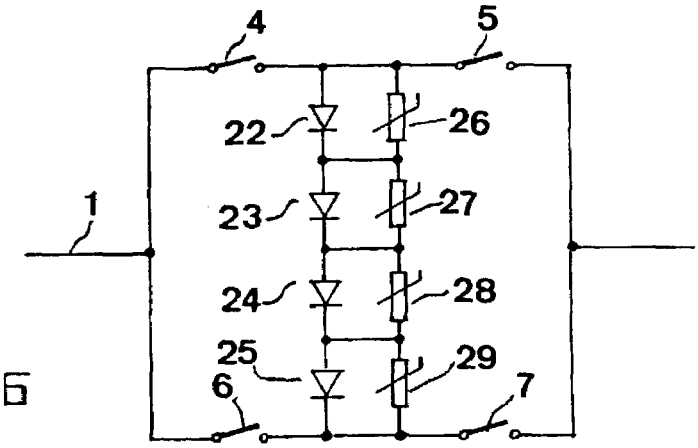
FIG. 16 illustrates very schematically a possible modification of a switching device according to the present invention.

Two additional aspects of the present invention are illustrated in FIG. 16, in which one is based on connecting a plurality of semiconductor devices 22–25 in series for being able to together take a certain returning voltage after breaking the current path. Thus, in all embodiments shown above each diode symbol may be replaced by a number of diodes connected in series in this way. It is here also possible to choose a material having a wide bandgap between the valence band and the conduction band, such SiC or diamond, for obtaining a lower number of the semiconductor devices required for a given voltage.

Figure 17:
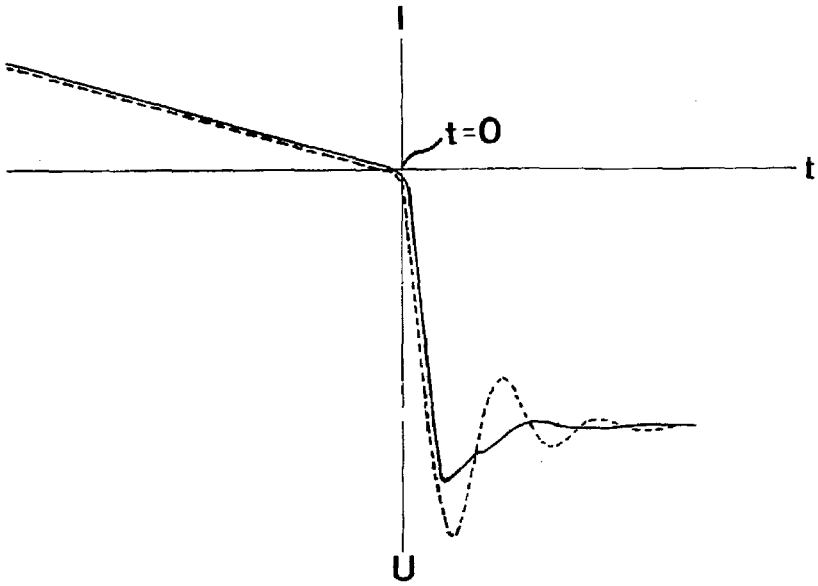
FIG. 17 illustrates how the current I through and a voltage U across the semiconductor devices of the embodiment according to FIG. 16 are developed versus time in comparison with the embodiment according to any of FIGS. 4–15.

The other aspect consists in connecting a varistor 26–29, preferably of ZnO, in parallel with each semiconductor device, in which the varistor is adapted to start conducting at a voltage thereacross close to the maximum voltage that may be withstood by the semiconductor device. This may be accomplished by the fact that the varistors do not normally conduct any current at all, since no voltage will be applied thereacross, but they will only receive a voltage thereacross in connection with the transition between the temporarily closed and the completely open position. It is illustrated in FIG. 17 how the voltage U over the semiconductor devices 22–25 in reverse direction thereof is developed over time t when the voltage increases thereacross in the temporarily closed position at the time zero. The dashed line shows how the voltage across the diodes is developed in the absence of varistors and the solid line with varistors. Thus, it appears that the varistors cut the first voltage peak off. Would for example four 5 kV-diodes be connected in series in a system having a network voltage of 12 kV and a normal returning voltage of 22 kV the varistors may in this way start conducting a small current during the short period of time (about 10 $\mu$s) that the peak of the returning voltage lasts, so that this voltage peak may be brought down to 18 kV. This means that 5 diodes connected in series are not required, but only four, for being able to take care of the returning voltage. The change of the current I is illustrated to the left of (before) the time 0. By connecting a separate varistor in parallel with each semiconductor device in this way it is avoided that any individual semiconductor device gets a higher voltage thereacross than it may withstand, while other semiconductor devices get a lower voltage thereacross. It is also possible to arrange resistances or capacitances connected in parallel with the semiconductor devices for distributing the voltage substantially equally over the semiconductor devices.

Figure 18:
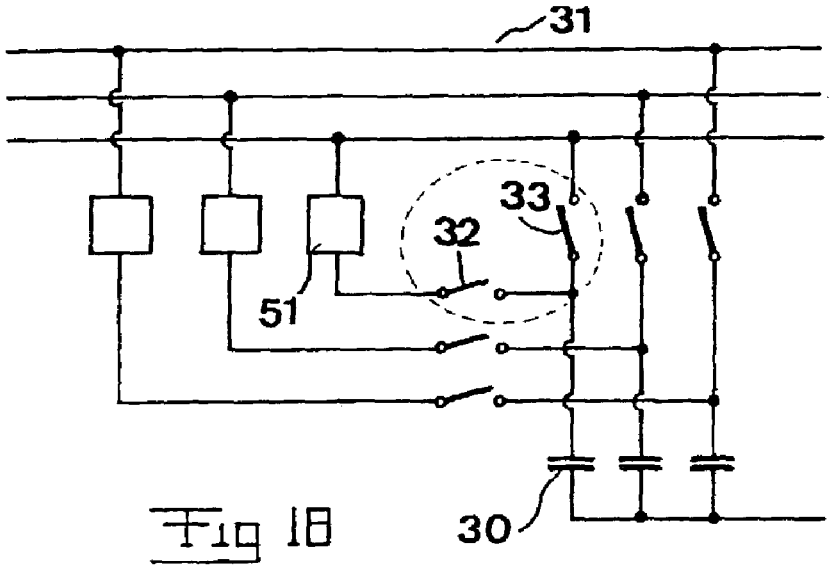
FIG. 18 is a simplified circuit diagram illustrating a possible use of an electric switching device according to the invention for switching in and switching out capacitors to an alternating voltage network for reactive power compensation.
Figure 19:
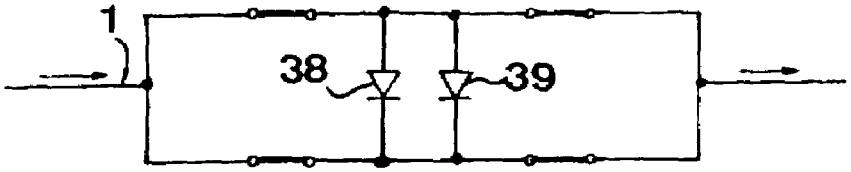
FIG. 19 illustrates very schematically an additional preferred embodiment of the invention.

A possible application of a semiconductor device according to the invention for switching in capacitors 30 to a three-phase alternating voltage network 31 for reactive power compensation is illustrated in FIG. 18. A switching device according to the invention may then replace two breakers 32, 33, such as illustrated in FIG. 18. When connecting the capacitor 30 to the phase in question of the alternating voltage network a breaker 32 may firstly be closed. Thyristors 51 connecting the breaker 32 to the phase in question are then turned on so that the capacitor 30 is switched in at a desired time. The breaker 33 is then closed. The breaker 32 is then opened, so that the thyristors not have to conduct any longer, but the breaker 33 is closed and the switching in of the capacitor is completed. By switching in the diode firstly in this way when the capacitor in question is to be switched in to the network, transient voltages on the network emanating from a certain residual voltage of the capacitor may be limited.

Figure 20:
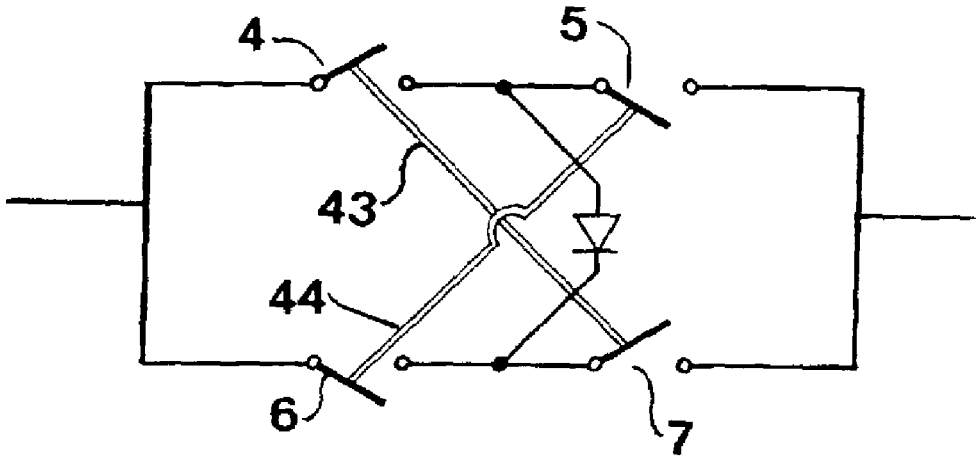
FIG. 20 illustrates very schematically a still further preferred embodiment of the invention.

It is illustrated in FIG. 20 how it is possible to connect semiconductor devices 38, 39 in parallel for being able to take certain shortcircuit current or just for redundancy reason, so that a switching device may function in a desired way even if any diode in one so-called package of diodes connected in series gets broken.

Figure 21:
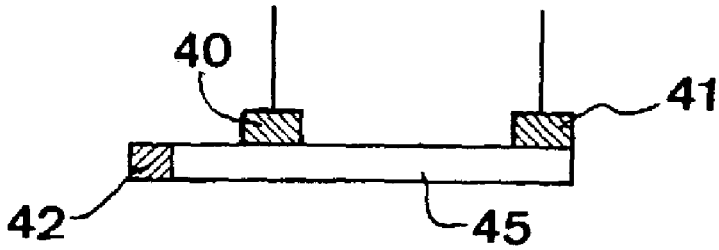
FIGS. 21 and 22 illustrate a part of a switching device in two different positions when breaking the current therethrough.

It is schematically illustrated in FIG. 21 how it may be possible to arrange one movable part 43, 44 crosswisely interconnecting the contact members 4 and 7 as well as 5 and 6, so that each movable part is adapted to close all contact members associated therewith in the closed position of the switching device (for the part 43 the contact members 4 and 7), in which each movable part is adapted to carry out one single mechanical movement for opening and closing the contact members associated therewith.

Figure 22:
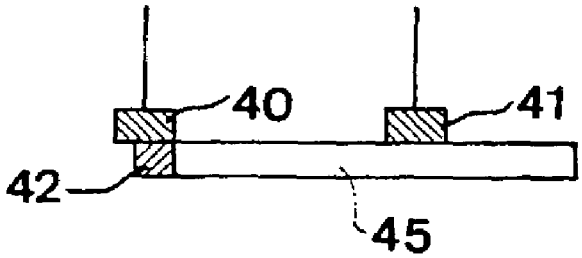

It is illustrated in FIG. 22 what means adapted to influence the voltage to increase upon separation of two contacts in connection with opening of the first contact member may look like. We now assume that the first contact member has two fixed contacts 40, 41, which are adapted to be galvanically connected through a movable part 45 in the closed state. The movable part 45 is at one end thereof provided with a portion 42 of a material having a comparatively high resistivity, so that the resistance between the movable part 45 and the contact 40 and thereby between the two contacts 40 and 41 is increased in the beginning of said separation (the position according to FIG. 23) while allowing a current between these contacts therethrough, so that a voltage that will drive the transfer of the current through the semiconductor device will be increased. The portion 42 may for example be made=of graphite.

Another advantage of an electric switching device according to the invention is obtained thanks to the fact that in the case of a three-phase voltage, which is most usual, the three electric switching devices for each phase are arranged controllable entirely independently of each other, which is not the case for such switching devices already known, which are mechanically interconnected with each other, so that they have to be all opened or closed simultaneously. When a fault occurs close to a generator connected to an alternating current network it is possible that an asymmetry of voltage may exist in any of the phases and it takes several periods before it gets zero, which means that it has for electric switching devices already known been a necessity to wait with the breaking until it is certain that a zero-crossing has been obtained for all phases, which may mean a delay in the order of 100 ms. A breaking of the phases where symmetry exists may thanks to the arrangement according to the invention of electric switching devices being independently controllable take place earlier than for a phase with said asymmetry, so that the harmful consequences of the currents created through a fault may be reduced considerably.

Figure 23:
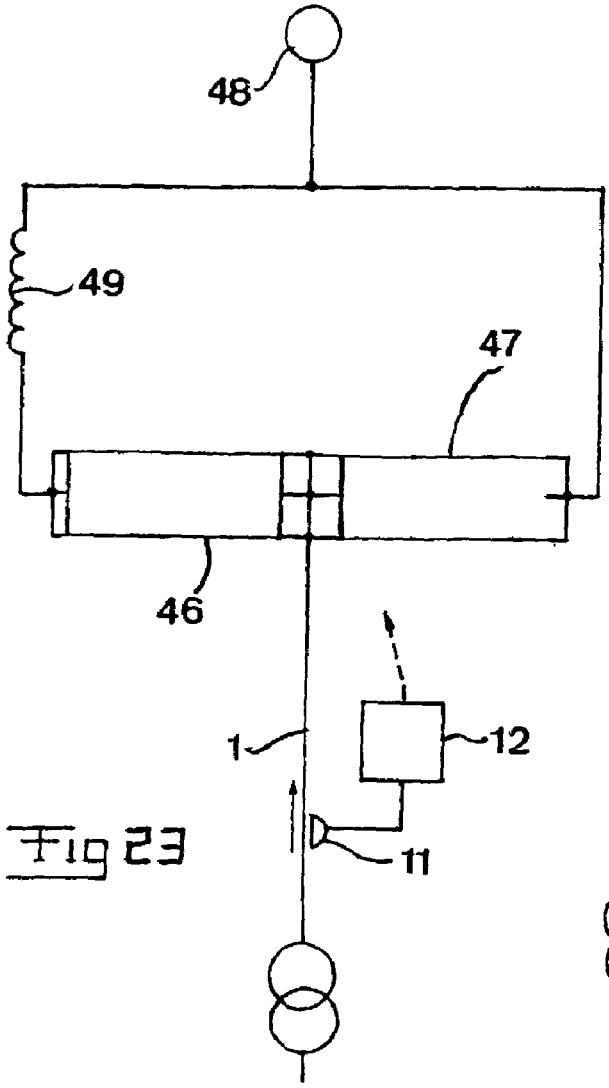
FIGS. 23 and 24 are schematical circuit diagrams illustrating two possible ways of arranging electric switching devices according to the invention for start of an electric motor.
Figure 24:
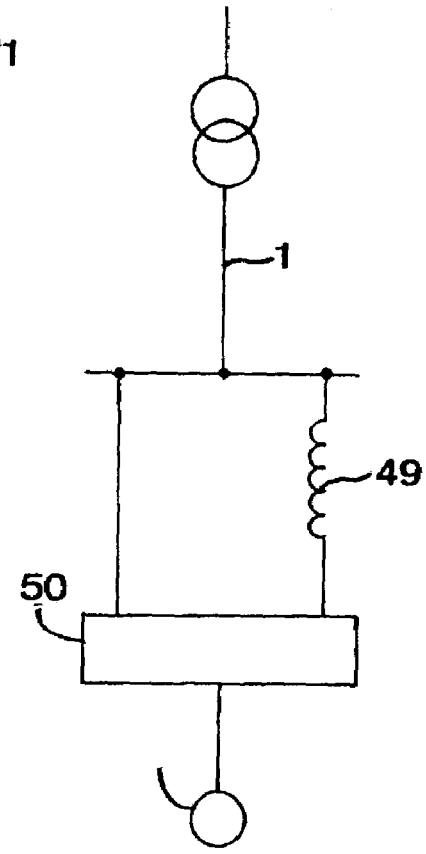

A possible application of a breaker according to the invention for motor starts is illustrated in FIGS. 23 and 24. It is here shown how two switching devices 46, 47 according to for example FIG. 4 are arranged and these may have a movable part 13, 14 in common. One of the switching devices is then connected to the motor 48 through a reactor 49, while the other is directly connected to the motor. Most power networks are not sufficiently stiff for allowing a start of large motors directly connected thereto, since these drain that much power that the voltage on the network will be reduced far too much. This problem may be solved by starting the motor according to different start methods, such as reactor start, capacitor start or transformer start, in which reactor start is illustrated here. When the motor is to be started the left switching device as seen in FIG. 23 is to be brought in a closed position, so that the motor 48 receives feeding through the reactor 49. Would it now for any reason be desired to interrupt the start the contacts of this switching device may be opened. When the motor then has reached a synchronous number of revolutions the reactor 49 may be disconnected by bringing the switching device in open position, while the switching device 47 is brought to closed position.

Would a shortcircuit occur in any equipment connected to the current path 1, the motor 48 will then start to run as a generator and contribute with power to the fault location before the fault has been disconnected. Here is a possibility to restrict the effect thereof by in such a case closing the switching device 46 and opening the switching device 47, so that the shortcircuit contribution from the motor to the fault location is restricted and the breaking of the motor is at the same time reduced. Would a shortcircuit occur in the motor or a planned stop be made, the switching device 47 will then be opened.

The two switching devices 46 and 47 are in FIG. 24 summarized through a box 50, and it is here shown that the switching devices may just as well be arranged in direct connection to the motor with a reactor arranged between the switching devices and the alternating voltage network 1.

Figure 25:
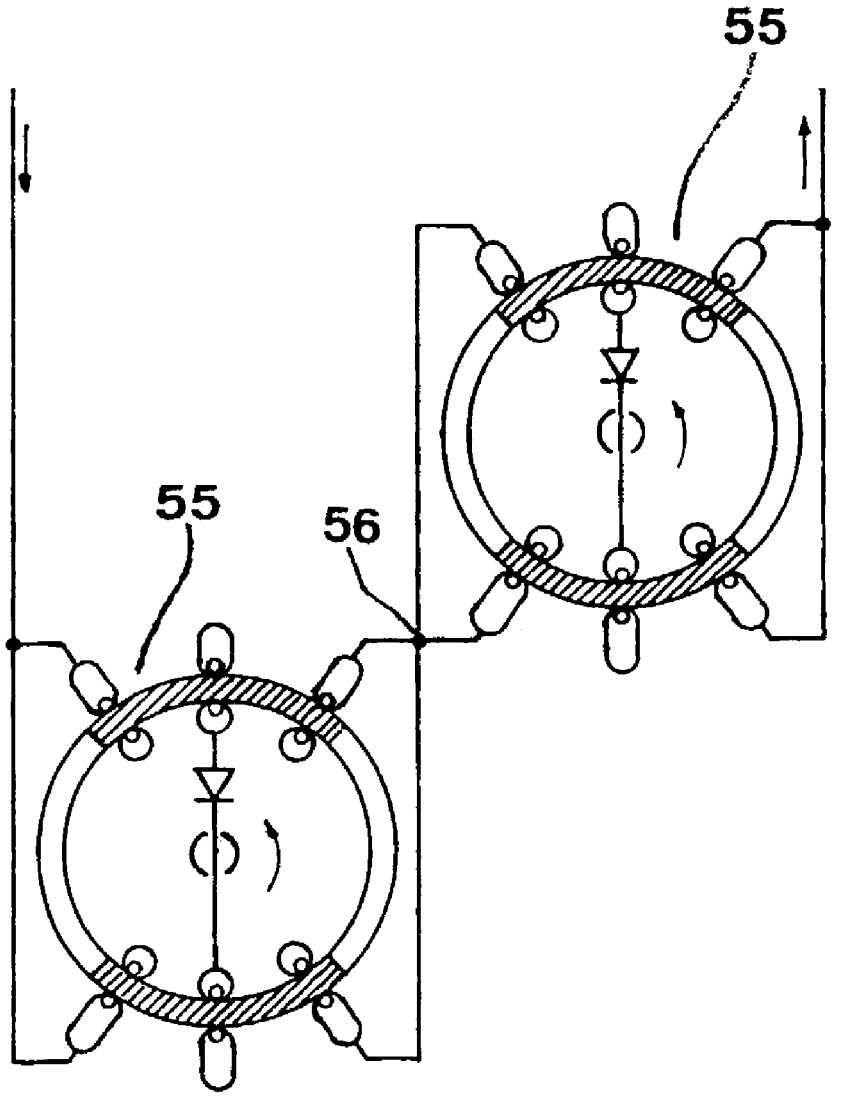
FIG. 25 is a view corresponding to FIG. 4 illustrating how two electric switching devices according to the invention may be connected in series.

It is illustrated in FIG. 25 how two electric switching devices 55 of the type shown in FIG. 4 have means 56 for being connected in series, so that they together may hold a higher voltage thereacross in the broken state than would only one switching device be arranged. It would of course be possible to arrange more than two such switching devices in series. The switching devices could then be mechanically rigidly connected to each other and be controlled simultaneously by one single driving member, but the provision of a possibility to individual control of the switching devices were also conceivable.

Preferred uses of an electric switching device according to the invention is as current limiter or connected in series with a current limiter or as a breaker, as protection for obtaining current breaking and/or disconnecting of parts in an electric circuit located on both sides thereof upon occurrence of faults, such as shortcircuits, for switching in and/or switching out normal operation currents of an electric circuit, as disconnector, as grounder for grounding an electric circuit, for switching in and out a generator with respect to an alternating voltage network, for switching in and switching out a resistive load with respect to an alternating voltage network, for switching in and switching out a resistive, capacitive or inductive load with respect to an alternating voltage network, for breaking current paths in switch gears for supply of electricity in industry or in distribution or transmission networks and for reactor start of an electric motor connected to an alternating voltage network.

Preferred is also a switching device according to claim 1 comprising current measuring members, an electronic unit adapted to carry out a current prediction algorithm and an electrically controlled driving member, such as a motor, for obtaining opening of the first contact member substantially at a zero-crossing of the current through the switching device.

The invention is of course not in any way restricted to the preferred embodiments described above, but many possibilities to modifications thereof would be apparent to a person skilled in the art without departing from the basic idea of the invention as defined in the claims.

It would for example be possible to increase the voltage of at least a spark created when separating two contacts in connection with opening of contact members for establishing the temporary current path of a switching device according to the invention, i.e. the voltage that will then result across the semiconductor device and drive the transfer of the current therethrough. This is possible to obtain by replacing each contact member by a series connection of a plurality of contact members. The voltage driving the current through the semiconductor device will be increased by a given voltage, for example 12–15 V, for each such contact member connected in series. It would also be possible to make at least some of the contacts included in the contact members of ablating material, such as Teflon, adapted to be heated and evaporated to gases for gas blowing on the spark when separating two contacts when opening the contact member in question, which would mean a higher voltage. Such an ablating material is a material able to be evaporated to gases.

It would also be possible to exchange the diodes shown above against other semiconductor devices having ability to block in at least one direction in accordance with the discussion above.

It is not absolutely necessary that the closing and the opening of the contact members of a switching device according to the invention takes place by a movement of two movable contact members included in the same unit and it is not even necessary that it takes place through movement of a movable contact part in common to a plurality of contact members. Each of the contact members could instead be completely separately controllable and for example consist of so-called Thomson-coils, which are then trigged according to the same time sequence as illustrated in for example FIGS. 1–3.

What is claimed is:

1. An electric switching device for alternating current comprising at least two contact members arranged in a current path through the switching device and a semiconductor device able to block current therethrough in at least a first blocking direction and a unit adapted to control opening of a current path through the switching device by controlling a first of the contact members to open for transferring the current through the switching device to the semiconductor device when this is in or going into the conducting state and then the second contact member to open when the semiconductor device is in a state of blocking current therethrough for breaking the current through the switching device, wherein the total number of contact members of the switching device are at least four with two connected in series in each of two branches connected in parallel in said current path, the semiconductor device being arranged to connect the midpoints between the two contact members of each branch to each other, the switching device comprises at least a member adapted to detect the direction of the current through the switching device, the control unit being adapted to control opening of the current path by controlling the first contact member located before said midpoint with respect to the current direction prevailing of one first branch to open and a second contact member of the second branch located after the midpoint with respect to the current direction to open for transferring the current to a temporary current path through the semiconductor device when this is in or going into the conducting state and then break the current path through the switching device when the semiconductor device is in a state of blocking current therethrough by opening at least one contact member of the switching device arranged in the temporary current path through the semiconductor device, and the control unit being adapted to chose which branch shall be the first one on the basis of information from the detecting member.

2. A switching device according to claim 1, wherein the control unit is adapted to open at least one of a) the second contact member of the first branch and b) the first contact member of the second branch after the transfer to the temporary current path for breaking the current path through the switching device.

3. A switching device according to claim 1, further comprising: at least an additional contact member having two contacts movable with respect to each other arranged between one of said midpoints and the branch between the two midpoints in which the semiconductor device is arranged, and wherein the unit is adapted to control opening of this additional contact member for breaking the temporary current path through the switching device.

4. A switching device according to claim 3, further comprising two said additional contact members arranged between one of said midpoints each and the branch including the semiconductor device.

5. A switching device according to claim 1, wherein the contact members comprise mechanical contact members each having least two contacts movable with respect to each other.

6. A switching device according to claim 5, further comprising: at least one movable contact part arranged to establish a galvanic connection between two fixed contacts of the respective contact member and break this connection for closing and opening, respectively, the contact member.

7. A switching device according to claim 6, wherein it has one single said movable part for all contact members arranged along one and the same of said branch connected in parallel, the movable part being adapted to close all the contact members of the branch in question in the closed state of the switching device, and a unit adapted to control this movable part to carry out one single mechanical movement for opening or closing the contact members of the respective branch.

8. A switching device according to claim 7, wherein the two movable parts are interconnected for opening and closing, respectively, the current through the switching device by one single mechanical movement of one unit in which the two movable parts are included.

9. A switching device according to claim 6, wherein it has two movable parts, one for each couple of first contact members of one branch and second contact members of the opposite branch, each movable part adapted to close all contact members associated therewith in the closed state of the switching device, and the unit adapted to control each movable part to carry out one single mechanical movement for opening or closing the contact members associated therewith.

10. A switching device according to claim 6, wherein the contact means are adapted to be closed by said movable part through a relative movement of a male and a female means into engagement with each other.

11. A switching device according to claim 10, wherein the movable part forms said male means, and that a female contact means is adapted to come to bear therearound when the movable part is moved into the female means.

12. A switching device according to claim 6, wherein the control unit is adapted to control the movable parts to move from the closed state of the switching device in one or the other direction along the movement path thereof depending upon the current direction detected by the detecting member.

13. A switching device according to claim 5, further comprising a driving member being electrically controlled and adapted to carry out movement of the movable part of the switching device for opening or closing contact members included therein.

14. A switching device according to claim 13, wherein the driving member comprises at least one of an electromagnetic machine and an electric machine.

15. A switching device according to claim 10, further comprising: a control unit in the form of an electronic unit adapted to control said driving member.

16. A switching device according to claim 1, wherein the contact members belonging to one and the same of said two branches are arranged along an arc.

17. A switching device according to claim 1, wherein the contact members belonging to said two branches are arranged along one and the same circle.

18. A switching device according to claim 1, wherein the contact members belonging to one and the same of said two branches are arranged along a straight line.

19. A switching device according to claim 18, further comprising: two movable parts to be controlled by the control unit to move in a rectilinear movement substantially in parallel with each other in at least one of the same direction and opposite directions for closing and both in the opposite direction to the closing direction for opening the contact members of each branch.

20. A switching device according to claim 18, wherein the contact members of the two branches are arranged along one and the same substantially straight line with the contact members of the respective branch following upon each other, and that the two movable parts for the respective branch are connected in series and the control unit is adapted to control them to move in one and the same direction along said substantially straight line for closing and both in the opposite direction to the closing direction for opening the current path.

21. A switching device according to claim 1, wherein said detecting member is adapted to substantially continuously detect the direction and the magnitude of the current through the switching device and send information thereabout to the control unit.

22. A switching device according to claim 1, further comprising: a plurality of said semiconductor devices connected in series and adapted to together hold a voltage across the switching device in the blocking state.

23. A switching device according to claim 22, wherein each semiconductor device has a said voltage limiting device each connected in parallel therewith for a substantially even distribution of the voltage across the series connection of the semiconductor devices onto the individual semiconductor devices.

24. A switching device according to claim 1, further comprising: means for connecting it in series with another such switching device for obtaining a series connection of such electric switching devices adapted to together hold a voltage across the series connection in the broken state of the switching devices.

25. A switching device according to claim 1, further comprising: a plurality of said semiconductor devices connected in parallel and adapted to together take care of the current through the switching device after opening the first contact member.

26. A switching device according to claim 1, wherein a voltage limiting device is connected in parallel with the semiconductor device, and said device being adapted to start conducting at a voltage thereacross close to the maximum voltage withstood by the semiconductor device.

27. A switching device according to claim 26, wherein the voltage limiting device comprises a varistor.

28. A switching device according to claim 1, further comprising means adapted to act increasingly upon the voltage when separating two contacts in connection with opening the first contact member.

29. A switching device according to claim 28, wherein said means comprises a plurality of first contact members connected in series adapted to be opened substantially simultaneously for transferring the current to the semiconductor device.

30. A switching device according to claim 28, wherein said means comprises one or a plurality of components adapted to increase the resistance between said two contacts at the beginning of said separation thereof while allowing a current between these contacts therethrough.

31. A switching device according to claim 30, wherein said component increasing the resistance is formed by a semiconductor device being controllable to be turned off so as to increase the voltage between said two contacts.

32. A switching device according to claim 30, wherein said component increasing the resistance is formed by a resistor having a controllable resistance and adapted to have an unimportant resistance in the closed state of the switching device and be controlled to get a substantial resistance for increasing the voltage between the two contacts.

33. A switching device according to claim 28, wherein said component increasing the voltage comprises a charged capacitor adapted to be switched in between said two contacts of the first contact member when this is to be opened.

34. A switching device according to claim 28 wherein said components are formed by the fact that the contacts included in the first contact member have at least a part of ablating material adapted to be heated and evaporated to gases for gas blowing on an arc when separating the two contacts when opening the first contact member.

35. A switching device according to claim 1, wherein the semiconductor device comprises at least one of a diode, a controllable device, a turn-off type device and a thyristor.

36. A switching device according to claim 35, wherein the semiconductor device is bi-directional.

37. A switching device according to claim 1, wherein the semiconductor device comprises a material having an energy gap between the valence band and the conduction band exceeding 2.5 eV, such as SiC and diamond.

38. A switching device according to claim 1 being operable at a system voltage between 1–52 kV.

39. A switching device according to claim 1 being operable, to withstand at least an operation current of 1 kA, preferably at least 2 kA, in the closed state.

40. A method for breaking a current path through an electric switching device for alternating current, in which a main current path through the switching device is opened and the current is transferred to a temporary current path through a semiconductor device able to block current therethrough in at least a first blocking direction when this is in or going into the conducting state and the temporary current path is then broken and the current through the switching device is by that broken, wherein the current path has two branches connected in parallel between a first and a second end of the switching device and cross-linked to each other through the semiconductor device, the direction and the magnitude of the current through the switching device is detected, for said breaking of the current path through the switching device firstly both branches are opened, one of them before as seen from said first end and the other after as seen from the first end the connection of the respective branch to the semiconductor device, wherein which of the branches is opened before and which is opened after said connection is made dependent upon the detection of the current, so that the current is transferred into a temporary current path between said two ends through one part of one of the branches, the semiconductor device and one part of the other branch when the semiconductor device is in or is going into the conducting state and the current path through the switching device is then broken when the semiconductor device is in a state of blocking current therethrough by opening said temporary current path.

41. A method according to claim 40, wherein the current through the switching device is detected and a future zero-crossing of the current is predicted on the basis of this detection, and the opening of the main current path is controlled to take place substantially at a zero-crossing of the current.

42. A computer program product adapted to be loaded directly into the internal memory of a computer and comprising software code portions for instructing a processor to carry out the steps according to claim 40 when the product is run on a computer.

43. A computer program product according to claim 42 provided at least partially over a network.

44. A computer readable medium having a program adapted to make a computer control the steps according to claim 40 recorded thereon.

* * * * *